US010288302B2

(12) United States Patent
Fujita

(10) Patent No.: US 10,288,302 B2
(45) Date of Patent: May 14, 2019

(54) CEILING-EMBEDDED AIR CONDITIONER WITH AIRFLOW GUIDE VANE

(71) Applicant: FUJITSU GENERAL LIMITED, Kawasaki-shi, Kanagawa-ken (JP)

(72) Inventor: Naoto Fujita, Kawasaki (JP)

(73) Assignee: FUJITSU GENERAL LIMITED, Kawasaki-Shi, Kanagawa-Ken (JP)

( * ) Notice: Subject to any disclaimer, the term of this patent is extended or adjusted under 35 U.S.C. 154(b) by 338 days.

(21) Appl. No.: 15/080,938

(22) Filed: Mar. 25, 2016

(65) Prior Publication Data

US 2016/0290662 A1 Oct. 6, 2016

(30) Foreign Application Priority Data

Mar. 31, 2015 (JP) ..... 2015-070936
Mar. 31, 2015 (JP) ..... 2015-070938

(51) Int. Cl.

| | |
|---|---|
| ***F24F 1/0011*** | (2019.01) |
| ***F24D 5/10*** | (2006.01) |
| ***F24D 19/02*** | (2006.01) |
| ***F24H 9/06*** | (2006.01) |
| ***F24F 7/00*** | (2006.01) |

(Continued)

(52) U.S. Cl.

CPC ..... *F24F 1/0014* (2013.01); *F24F 1/0022* (2013.01); *F24F 13/08* (2013.01); *F24F 13/1426* (2013.01); *F24F 13/15* (2013.01); *F24F 13/20* (2013.01); *F24F 13/22* (2013.01); *F24F 13/30* (2013.01); *F24F 1/0011* (2013.01);

(Continued)

(58) Field of Classification Search

CPC ..... F24F 1/0011; F24F 1/0014; F24F 13/08; F24F 13/14; F24F 13/082; F24F 13/142; F24F 2001/0037

USPC ..... 165/53; 454/301

See application file for complete search history.

(56) References Cited

U.S. PATENT DOCUMENTS 5,577,958 A * 11/1996 Kumekawa ..... F15D 1/04 454/233
6,393,856 B1 * 5/2002 Gunji ..... F24F 1/0011 62/259.1

(Continued)

FOREIGN PATENT DOCUMENTS

CN 101676638 A * 3/2010 ..... F24F 1/0014
JP WO 0135032 A1 * 5/2001 ..... F24F 1/0011

(Continued)

OTHER PUBLICATIONS

Translation of Chinese Patent Document entitled Translation-CN 101676638 A.*

*Primary Examiner* — Paul Alvare
(74) *Attorney, Agent, or Firm* — Manabu Kanesaka

(57) ABSTRACT

A ceiling-embedded air conditioner includes a decorative panel, a turbo fan, a heat exchanger, a drain pan, an air suction path, air blowoff paths provided at four places along the sides of a virtual square surrounding the air suction path, and an air blowoff opening communicating with the air blowoff path. The air blowoff path is formed in a cuboidal shape having a pair of long side walls disposed with a predetermined space therebetween in parallel to the sides of the virtual square and a pair of short side walls connecting the ends of the long side walls. Airflow guide vanes are provided in the air blowoff paths to direct part of blown airflow toward the short side of the air blowoff opening.

11 Claims, 14 Drawing Sheets

(51) Int. Cl.

| | |
|---|---|
| ***F24F 13/08*** | (2006.01) |
| ***F24F 13/072*** | (2006.01) |
| ***F24F 1/0014*** | (2019.01) |
| ***F24F 1/0022*** | (2019.01) |
| ***F24F 13/14*** | (2006.01) |
| ***F24F 13/15*** | (2006.01) |
| ***F24F 13/20*** | (2006.01) |
| ***F24F 13/22*** | (2006.01) |
| ***F24F 13/30*** | (2006.01) |
| *F24F 1/00* | (2019.01) |
| *F24F 13/06* | (2006.01) |

(52) U.S. Cl.
CPC ..... *F24F 2001/0037* (2013.01); *F24F 2013/0616* (2013.01); *F24F 2013/1433* (2013.01)

(56) References Cited

U.S. PATENT DOCUMENTS

| | | | | |
|---|---|---|---|---|
| 8,511,108 | B2 * | 8/2013 | Yabu | F24F 1/0011 165/53 |
| 2002/0177400 | A1 * | 11/2002 | Asahina | F24F 1/0011 454/233 |
| 2010/0192611 | A1 * | 8/2010 | Yamaguchi | F24F 1/0014 62/291 |
| 2015/0090429 | A1 * | 4/2015 | Jeong | F24F 13/20 165/121 |

FOREIGN PATENT DOCUMENTS

| | | | | |
|---|---|---|---|---|
| JP | 4052264 | B2 | 2/2008 | |
| JP | WO 2014174625 | A1 * | 10/2014 | F24F 1/0011 |

* cited by examiner

CEILING-EMBEDDED AIR CONDITIONER WITH AIRFLOW GUIDE VANE

CROSS-REFERENCE TO RELATED APPLICATION

This application claims priority from Japanese Patent Application Nos. 2015-070936 and 2015-070938 filed with the Japan Patent Office on Mar. 31, 2015, the entire contents of which are hereby incorporated by reference.

BACKGROUND

1. Technical Field

The present disclosure relates to a ceiling-embedded air conditioner that is embedded between a ceiling slab and a ceiling panel. More specifically, the present disclosure relates to a ceiling-embedded air conditioner that has a blowoff structure blowing air from a decorative panel to all directions.

2. Description of the Related Art

In a ceiling-embedded air conditioner, a box-shaped casing main body is embedded into a space formed between a ceiling slab and a ceiling panel. A square decorative panel is mounted on the bottom surface (facing the interior of a room) of the casing main body. In general, an air suction opening is provided in the center of the decorative panel, and air blowoff openings are provided around the air suction opening. The casing main body includes a turbo fan, a heat exchanger surrounding the outer periphery of the turbo fan, and a drain pan disposed under the heat exchanger (for example, refer to Japanese Patent No. 4052264).

In conventional ceiling-embedded air conditioners however, the air blowoff openings are at four places along the four sides of the decorative panel. The conditioned air having passed through the heat exchanger is blown from the sides of the decorative panel to the four directions. Meanwhile, no air flows into the four corners (corner portions). This easily generates variations in room temperature.

Accordingly, the ceiling-embedded air conditioner disclosed in Japanese Patent No. 4052264, air blowoff paths are provided along the entire circumference of the drain pan in the casing. Besides the air blowoff openings disposed along the four sides of the decorative panel, auxiliary blowoff openings are provided at the corner portions of the decorative panel to connect the adjacent ends of the air blowoff openings. Accordingly, the air blowoff openings form an octagonal ring shape. Wind direction plates are disposed at the air blowoff openings to allow the air to be blown to almost all directions.

SUMMARY

A ceiling-embedded air conditioner includes: a casing main body embedded in a ceiling; a decorative panel mounted on the lower surface of the casing main body; a turbo fan disposed in the casing main body; a heat exchanger disposed in the casing main body to surround the outer periphery of the turbo fan; a drain pan that is disposed in the casing main body along the lower side of the heat exchanger; an air suction path that is disposed in the center of the drain pan and reaches the turbo fan; an air blowoff path for conditioned air having passed through the heat exchanger, the air blowoff path being provided at four places along the sides of a virtual square surrounding the air suction path; an air suction opening that is provided in the decorative panel and communicates with the air suction path; and an air blowoff opening that is provided in the decorative panel and communicates with the air blowoff path. The air blowoff path is formed in a cuboidal shape having a pair of long side walls disposed with a predetermined space therebetween in parallel to the sides of the virtual square and a pair of short side walls connecting the ends of the long side walls, and an airflow guide vane is provided in the air blowoff path to direct part of the blown airflow of the conditioned air toward the short side of the air blowoff opening.

DESCRIPTION OF THE EMBODIMENTS

Figure 1:
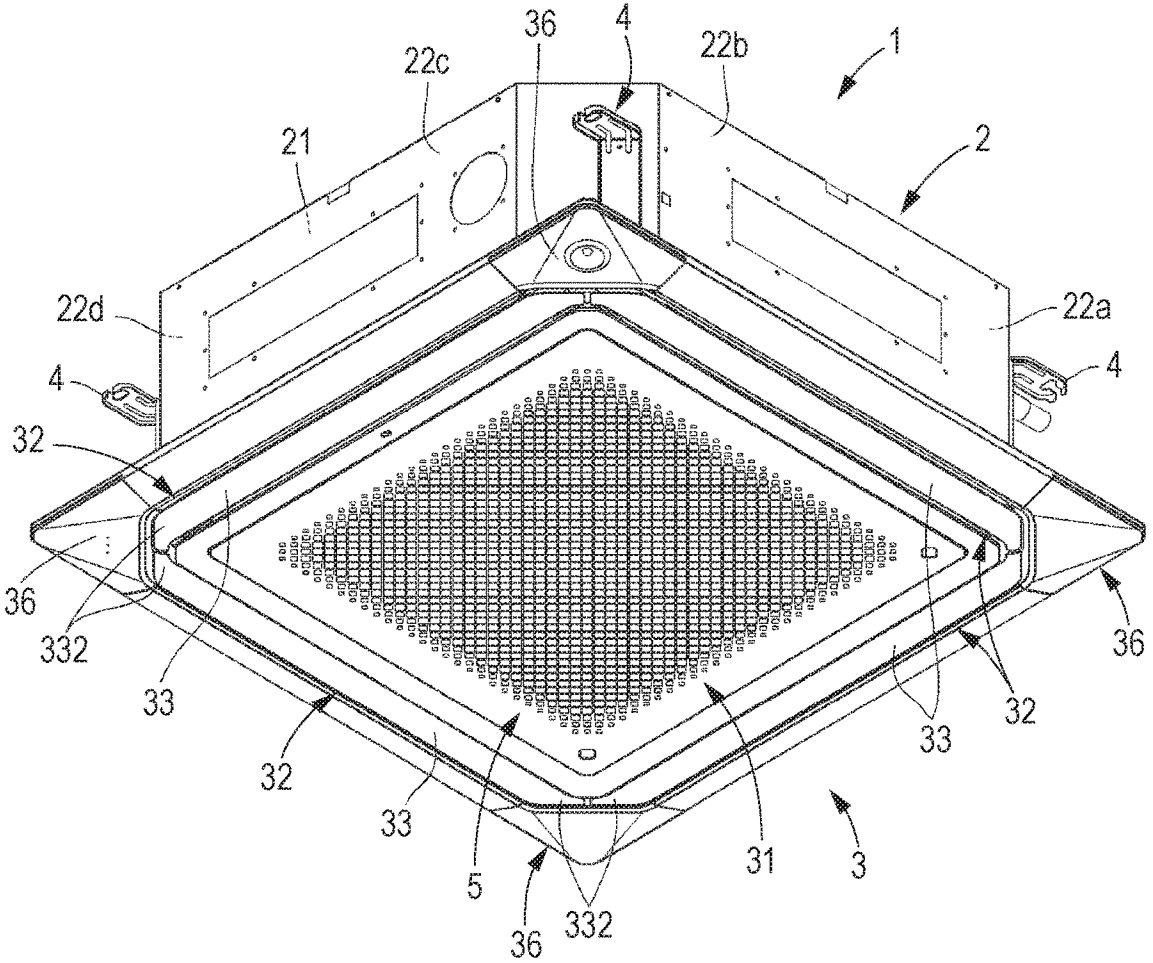
FIG. 1 is a perpendicular external view of a ceiling-embedded air conditioner according to an embodiment of the present disclosure.

In the following detailed description, for purpose of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawing.

According to the conventional technique described in Japanese Patent No. 4052264, the air blowoff openings form an octagonal ring shape, and the wind direction plates are disposed at the air blowoff openings. Accordingly, the air conditioner is inevitably complicated in structure. This leads to increases in parts count and man-hours for assembly work, which is unfavorable from the viewpoint of costs.

The drain pan is generally made of a foamed polystyrene resin material. According to the foregoing conventional technique, the air blowoff paths of a foamed polystyrene resin material are integrated with the drain pan on the entire circumference of the drain pan. Accordingly, the air blowoff paths are low in mechanical strength.

An object of the present disclosure is to provide a ceiling-embedded air conditioner that allows efficient blowing of the conditioned air to all directions by smaller parts count and man-hours.

A ceiling-embedded air conditioner according to an aspect of the present disclosure (the present air conditioner) includes: a casing main body embedded in a ceiling; a decorative panel mounted on the lower surface of the casing main body; a turbo fan disposed in the casing main body; a heat exchanger disposed in the casing main body to surround the outer periphery of the turbo fan; a drain pan that is disposed in the casing main body along the lower side of the heat exchanger; an air suction path that is disposed in the center of the drain pan and reaches the turbo fan; an air blowoff path for conditioned air having passed through the heat exchanger, the air blowoff path being provided at four places along the sides of a virtual square surrounding the air suction path; an air suction opening that is provided in the decorative panel and communicates with the air suction path; and an air blowoff opening that is provided in the decorative panel and communicates with the air blowoff path. The air blowoff path is formed in a cuboidal shape having a pair of long side walls disposed with a predetermined space therebetween in parallel to the sides of the virtual square and a pair of short side walls connecting the ends of the long side walls, and an airflow guide vane is provided in the air blowoff path to direct part of the blown airflow of the conditioned air toward the short side of the air blowoff opening.

In a more preferable aspect, the airflow guide vane includes: a first airflow guide vane that directs part of the blown airflow of the conditioned air toward one short side of the air blowoff opening; and a second airflow guide vane that directs part of the blown airflow of the conditioned air toward the other short side of the air blowoff opening.

Moreover, in a preferable aspect, the airflow guide vane includes: a base plate disposed along the long side walls; and a plurality of guide fins that is vertically erected from the base plate in parallel to one another with a predetermined space therebetween. The guide fins have upstream-side base end portions along the blown airflow and downstream-side leading end portions inclined in an arc shape in the direction of the airflow with a predetermined curvature, the upstream-side base end portions being formed in a flat plate shape parallel to the direction of airflow.

In a more preferable aspect, the width of the base end portions of the guide fins is equal to the width between the long side walls and the width of the leading end portions of the guide fins is gradually smaller with increasing proximity to the tips.

In a further more preferable aspect, the base end portions formed in a flat plate shape parallel to the airflow has a length of ⅓ of a path length of the air blowoff path, and the leading end portions formed in an arc shape in the direction of the airflow has a length of ⅔ of the path length of the air blowoff path.

The ceiling-embedded air conditioner in another aspect further includes a lock piece that is provided at the upper end of the base plate and attaches the airflow guide vane to the long side wall of the air blowoff path.

The ceiling-embedded air conditioner in one more another aspect further includes a wind guide path that is formed in a space between adjacent ends of the adjacent air blowoff openings at corner portions of the decorative panel. The airflow guide vane allows part of blown airflow of the conditioned air to be blown toward the wind guide path from the adjacent air blowoff paths.

The ceiling-embedded air conditioner in a more preferable aspect further includes: a wind guide path that is formed in a space between adjacent ends of the adjacent air blowoff openings at corner portions of the decorative panel; a wind direction plate that is provided in the air blowoff opening and has on both ends inclined portions covering half portion of the wind guide path; and a stepping motor that is provided on the one short side wall of the air blowoff path and rotates the wind direction plate. The first airflow guide vane is disposed on the one short side wall side of the air blowoff path provided with the stepping motor, and the second airflow guide vane is disposed on the other short side wall side of the air blowoff path.

More preferably, the direction of inclination of the guide fins of the first airflow guide vane and the direction of inclination of the guide fins of the second airflow guide vane are separated from each other, and an inclination angle $\theta 1$ of the guide fins of the first airflow guide vane with respect to a virtual horizontal plane and an inclination angle $\theta 2$ of the guide fins of the second airflow guide vane with respect to the virtual horizontal plane are in the relationship $\theta 1 > \theta 2$.

According to the present air-conditioner, the airflow guide vanes are disposed in the cuboidal air blowoff path. In addition, part of the air flowing in the air blowoff path is forcibly blown by the airflow guide vanes toward the short side of the air blowoff opening. This allows air blowing to all directions without using a complicated structure.

In one more another aspect, the first airflow guide vane is disposed in the air blowoff path on the one short side wall side, the second airflow guide vane is disposed in the air blowoff path on the other short side wall side, the first and second airflow guide vanes include a base plate disposed along the long side wall and a plurality of guide fins that is vertically erected from the base plate in parallel to one another with a predetermined space therebetween, and when the distance from the one short side wall to the outmost guide fin as the guide fin most distant from the one short side wall out of the guide fins in the first airflow guide vane is designated as A, the distance from the other short side wall to the outmost guide fin as the guide fin most distant from the other short side wall out of the guide fins in the second airflow guide vane is designated as B, and the length of the long side wall of the air blowoff path is designated as C, the first and second airflow guide vane are positioned to satisfy the relationship $(A+B)/C<0.5$.

In a more preferable aspect, the first and second airflow guide vanes are provided such that the lower end portions of the guide fins are positioned to be flush with an opening surface of an outflow-side opening portion of the air blowoff path or are positioned more inside the air blowoff path than the opening surface.

In the foregoing mode, the length of the central air guide path formed between the first airflow guide vane and the second airflow guide vane becomes ½ or more of the length C of the long side wall of the air blowoff path. Accordingly, the wind velocity of the air flowing in the central air guide path is less prone to decline. This allows even and efficient air blowing to all directions.

Next, an embodiment of the subject disclosure will be described with reference to the drawings. However, the technique of the present disclosure is not limited to this.

Figure 2:
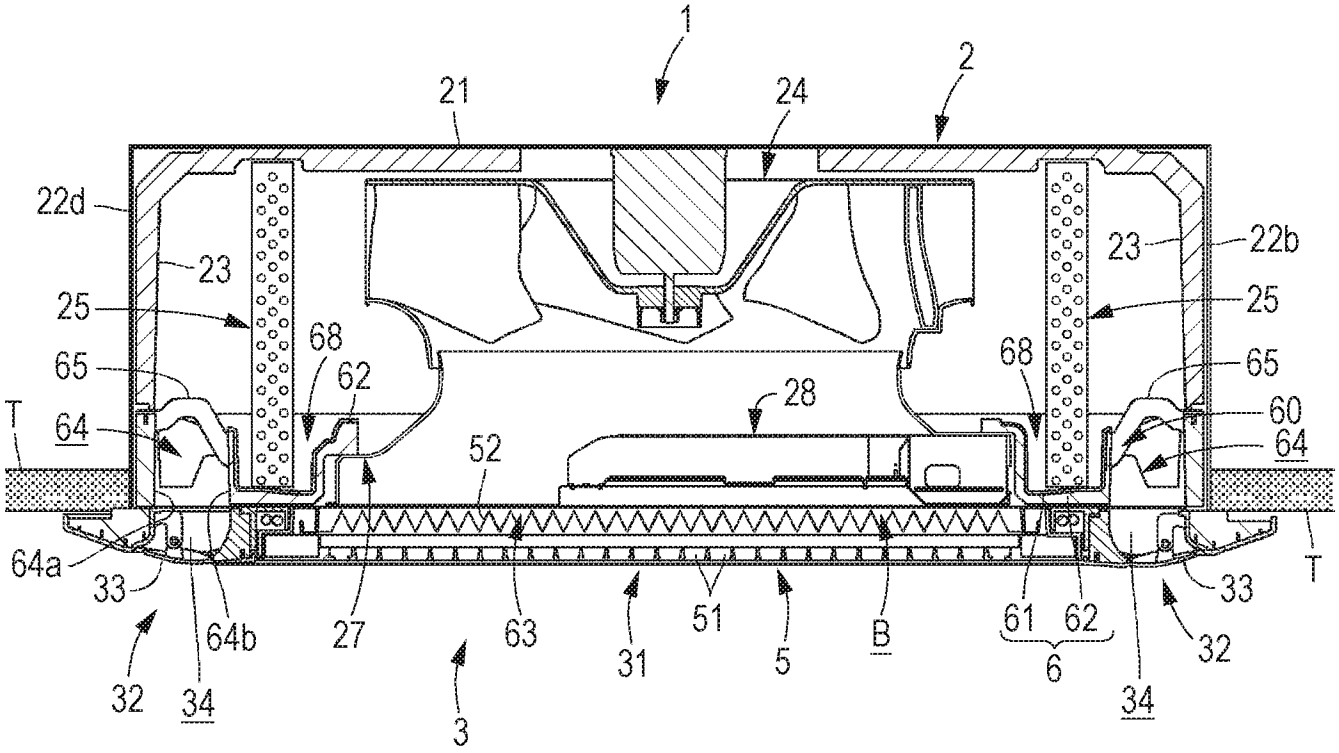
FIG. 2 is a cross-sectional view of main components of the ceiling-embedded air conditioner.

As illustrated in FIGS. 1 and 2, a ceiling-embedded air conditioner 1 includes a cuboidal casing main body 2 and a decorative panel 3. The casing main body 2 is embedded in the ceiling. Specifically, the casing main body 2 is stored in a space formed between a ceiling slab and a ceiling panel T. The decorative panel 3 is mounted on a bottom surface B of the casing main body 2.

The casing main body 2 is a box-shaped container. The casing main body 2 has a square top plate 21 and four side plates 22*a* to 22*d* extending downward from the sides of the top plate 21. The bottom surface B (bottom surface in FIG. 1) of the casing main body 2 is opened. A heat insulator 23 made of foamed polystyrene is provided on the inner peripheral surface of the casing main body 2, for example.

Hanging metal brackets 4 are provided at the four corner portions of the casing main body 2. When the hanging metal brackets 4 are locked to hanging bolts not illustrated hung from the ceiling, the ceiling-embedded air conditioner 1 is hung from and fixed to the ceiling.

As illustrated in FIG. 2, a turbo fan 24 as an air blower is disposed in almost the center of inside of the casing main body 2. A heat exchanger 25 is disposed in a square frame shape, for example, on the outer periphery of the turbo fan 24 to surround the turbo fan 24.

Figure 8:
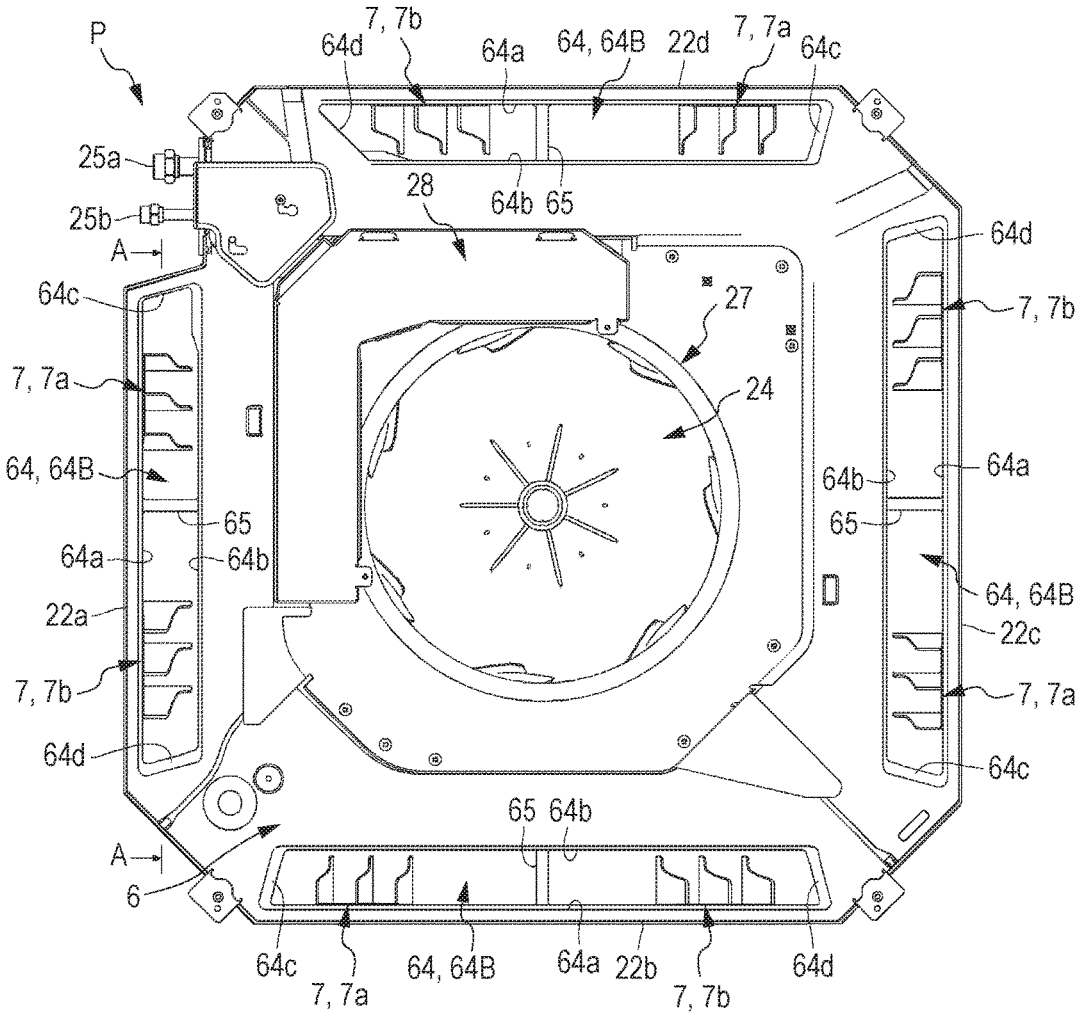
FIG. 8 is a front view of the casing main body seen from the bottom side (ceiling panel side)

Also referring to FIG. 8, a concave portion is formed in the casing main body 2 at one of the four corner portions (in this example, the corner portion between the side plates 22*a* and 22*d*) by recessing the corner portion by one step from outside to inside. A pipe draw portion P is provided at the concave portion to draw refrigerant pipes 25*a* and 25*b* of the heat exchanger 25 to the outside.

A drain pan 6 is disposed along the side under the heat exchanger 25 to receive dew condensation water generated by the heat exchanger 25 during cooling operation (see FIG. 2). In the embodiment, the drain pan 6 is made of a foamed polystyrene resin. The drain pan 6 includes a drain pan main body 61 made of a foamed resin having a dew receiving portion 68, air blowoff paths 64, and resin drain sheets 62. The air blowoff paths 64 guide the conditioned air having passed through the heat exchanger 25 to air blowoff openings 32 of the decorative panel 3. The resin drain sheets 62 are integrated with the drain pan main body 61 on the heat exchanger 25 side.

The drain pan 6 has a square frame shape in a plane view. The square frame of the drain pan 6 constitutes an air suction path 63 communicating with an air suction opening 31 of the decorative panel 3. A bell mouth 27 is provided in the air suction path 63. The bell mouth 27 guides the air sucked from the air suction opening 31 toward the suction side of the turbo fan 24. That is, the air suction path 63 is a path that is disposed in the center of the drain pan 6 and reaches the turbo fan 24.

Figure 7:
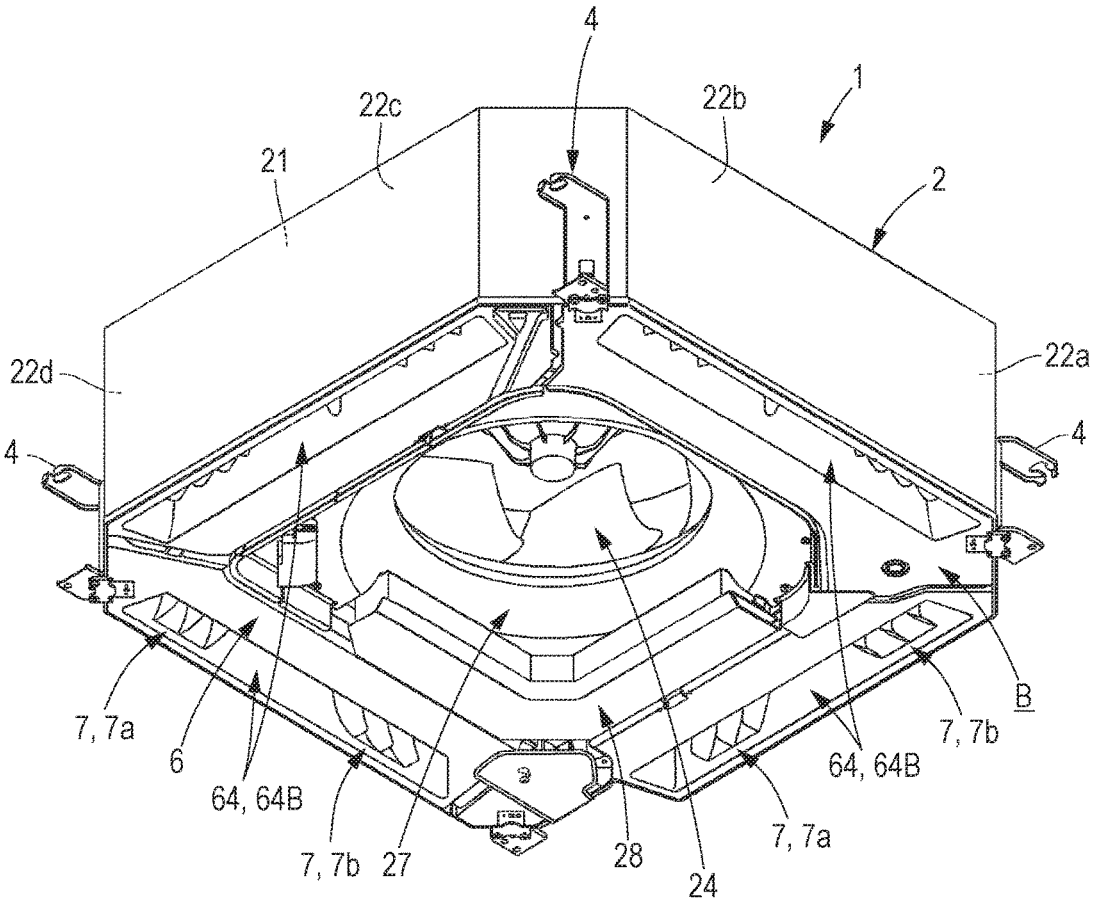
FIG. 7 is a perspective view of the main body casing without decorative panels seen from the bottom side.

Also referring to FIG. 7, an electric equipment box 28 is provided in the bell mouth 27 on the air suction opening 31 side. In the embodiment, the electric equipment box 28 is disposed in an L shape at the corner portion close to the pipe draw portion P.

In the embodiment, the air blowoff paths 64 are provided in the casing main body 2 at four places corresponding to the air blowoff openings 32 of the decorative panel 3. Specifically, the air blowoff paths 64 are provided at the four places along the sides of a virtual square Q (shown by a two-dot chain line in FIG. 5) surrounding the air suction path 63. The four air blowoff paths 64 are almost the same in basic configuration, and one of them will be described with reference to FIGS. 7 and 8.

The air blowoff path 64 has a cuboidal shape surrounded by a pair of long side walls 64*a* and 64*b* and a pair of short side walls 64*c* and 64*d*. The pair of long side walls 64*a* and 64*b* is parallel to the side plates 22*a* to 22*d* (the sides of the virtual square Q) of the casing main body 2 formed in parallel to one another, and is opposed to each other with a predetermined space therebetween. The pair of short side walls 64*c* and 64*d* are formed between the ends of the long side walls 64*a* and 64*b* to connect the ends of the long side walls 64*a* and 64*b*. The air blowoff path 64 penetrates through the casing main body 2 in the up-down direction (the direction vertical to the plane in FIG. 8). In the embodiment, the air blowoff path 64 is integrated with the drain pan 6.

Figure 3:
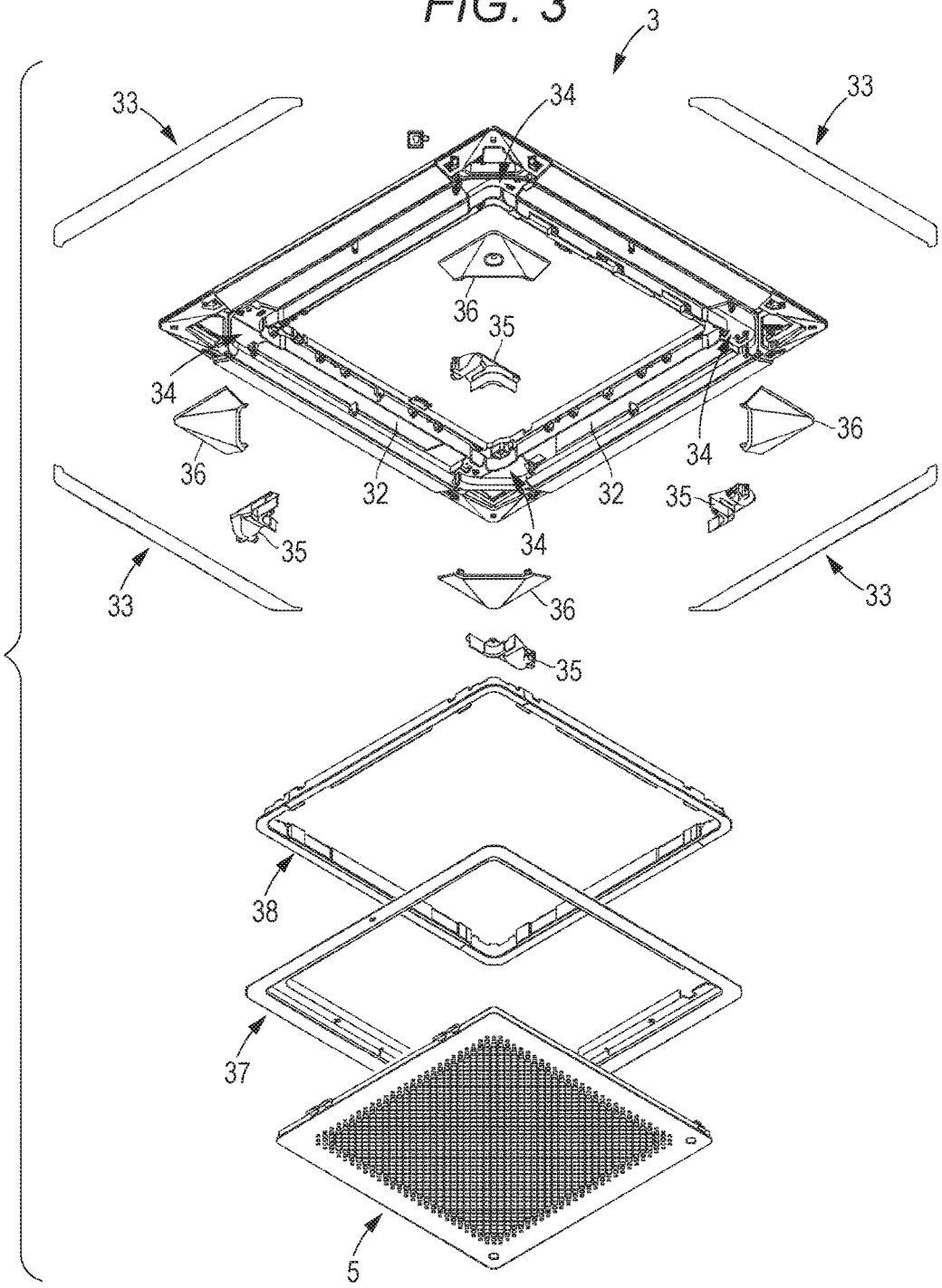
FIG. 3 is an exploded perspective view of a decorative panel seen from the bottom side.
Figure 4A:
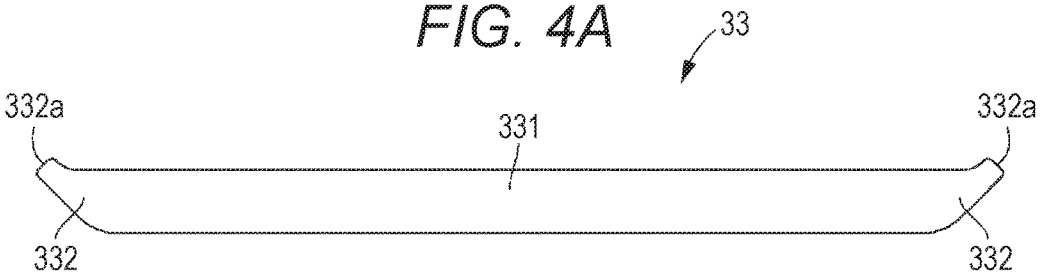
FIG. 4A is a front view of a wind direction plate.
Figure 4B:
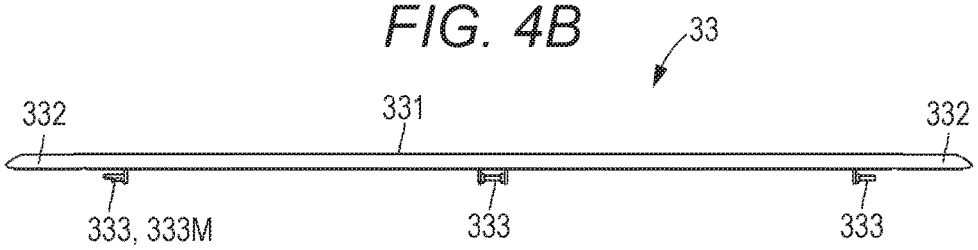
FIG. 4B is a plane view of the wind direction plate.
Figure 4C:
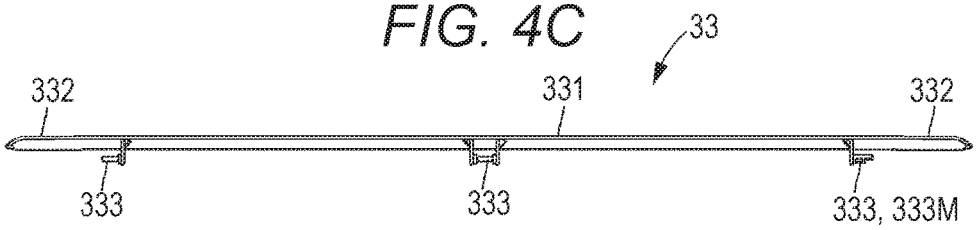
FIG. 4C is a bottom view of the wind direction plate.
Figure 4D:
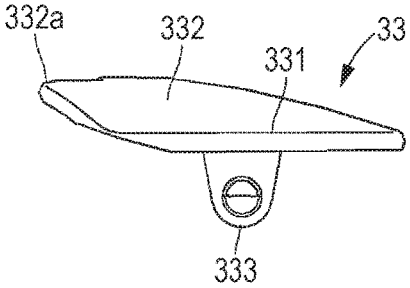
FIG. 4D is a left side view of the wind direction plate.
Figure 4E:
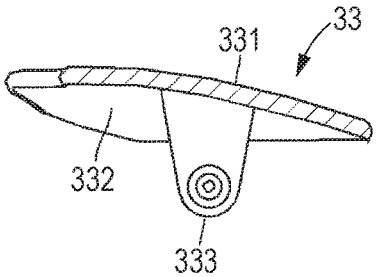
FIG. 4E is a vertical section-view of the wind direction plate in the middle.

Outflow-side opening portions 64B of the air blowoff paths 64 communicate with the air blowoff openings 32 of the decorative panel 3. Referring again to FIGS. 1 to 3, the decorative panel 3 has a square flat frame shape screwed to the bottom surface of the casing main body 2.

The decorative panel 3 has the air suction opening 31 opened in a square in the center and communicating with the air suction path 63. The rectangular air blowoff openings 32 communicating with the air blowoff path 64 are disposed at four places along the four sides of the air suction opening 31. A suction grill 5 is detachably attached to the air suction opening 31.

The suction grill 5 is a synthetic resin molded article having a large number of suction holes 51. A dedusting filter 52 is held on the back surface of the suction grill 5. In the embodiment, the suction grill 5 is mounted on the decorative panel 3 via a suction grill frame 37 to which a heat insulating member 38 made of foamed polystyrene is attached.

The air blowoff openings 32 provided in the decorative panel 3 penetrate through the decorative panel 3 in the up-down direction. The air blowoff openings 32 are opened in a rectangular shape in a bottom view. The air blowoff openings 32 are disposed at four places in parallel to the sides of the virtual square Q (shown by the two-dot chain line in FIG. 5) to surround the four sides of the air suction opening 31.

The ends of the air blowoff openings 32 are opposed to each other at the four corner portions 36. Wind guide paths 34 are provided at the four corner portions 36. The wind guide paths 34 are formed in spaces between the adjacent ends of the adjacent air blowoff openings 32. The wind guide paths 34 guide the air blown from the adjacent air blowoff openings 32 to the corner portions 36 of the decorative panel 3. The wind guide paths 34 are concave grooves that are recessed inward by one step from the surface (bottom surface) of the decorative panel 3. The wind guide paths 34 are formed in an L shape. The wind guide paths 34 each have a portion parallel to a longitudinal axial line of one air blowoff opening 32 and a portion parallel to a longitudinal axial line of the other air blowoff opening 32 orthogonal to the former portion.

Wind direction plates 33 are rotatably disposed at the air blowoff openings 32. As illustrated in FIG. 4A to 4E, each of the wind direction plates 33 includes a straight-line portion 331 and inclined portions 332 and 332. The straight-line portion 331 is formed in a linear shape suited to the shape of the air blowoff opening 32. The inclined portions 332 and 332 are integrated with the straight-line portion 331 at the both ends of the straight-line portion 331 to cover the wind guide path 34. For example, the inclined portions 332 and 332 cover half portion of the wind guide path 34.

The straight-line portion 331 is formed such that the front side (the upper side in FIG. 4E) has a gently curved convex surface and the back side (the lower side in FIG. 4E) has a gently curved concave surface suited to the front side.

The inclined portions 332 are formed in the same manner as the straight-line portion 331 such that the front side has a convex surface and the back side has a concave surface. The concave surface on the back side is formed such that the air is guided to the tips 332*a* of the inclined portions 332.

The wind direction plates 33 each have rotation shafts 333 for rotating the wind direction plate 33 on the back side thereof. In the embodiment, the rotation shafts 333 are provided at three places of the straight-line portion 331, the right and left ends and the middle. The rotation shafts 333 are on the same axial line to rotate horizontally the wind direction plate 33.

Two of the three rotation shafts 333 are locked in bearing portions not illustrated on the decorative panel 3. The remaining one rotation shaft 333 (the rotation shaft 333M in this example) is connected to a rotation drive shaft of a stepping motor 35 (see FIG. 3) described later.

Stepping motors 35 for rotating the wind direction plates 33 are provided in the wind guide paths 34. In the embodiment, the one each stepping motor 35 is provided for the one each wind direction plate 33 (total four stepping motors). In the embodiment, each of the stepping motors 35 is adjacent to one short side of the air blowoff opening 32 (on the short side wall 64*c* side of the air blowoff path 64).

According to this, as illustrated in FIG. 1, at the time of stoppage of operation, the wind direction plates 33 rotate horizontally in parallel to the air blowoff openings 32 to cover the air blowoff openings 32. At that time, the inclined portions 332 of the adjacent wind direction plates 33 are brought into abutment with each other. Accordingly, the wind guide paths 34 are also covered.

Figure 5:
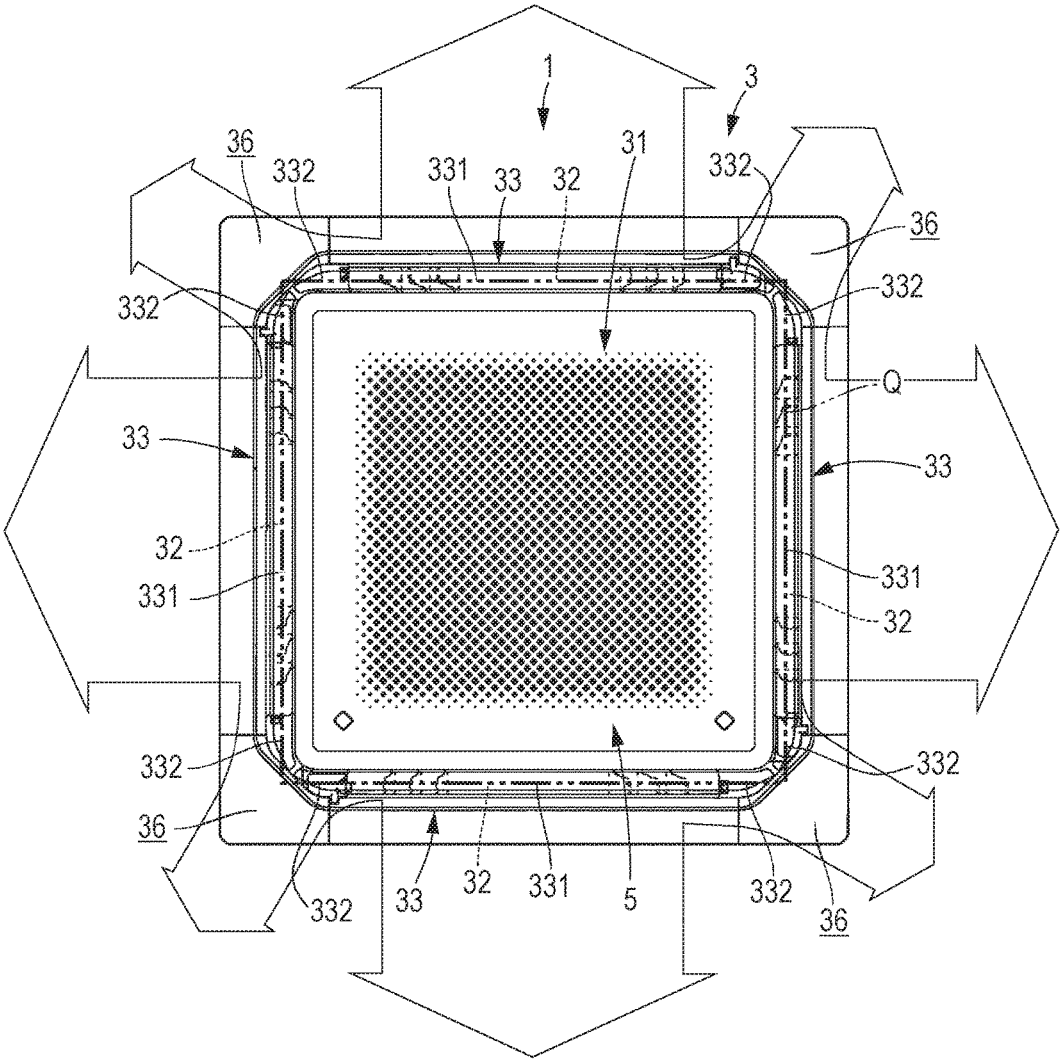
FIG. 5 is a front view of the ceiling-embedded air conditioner seen from the bottom side (ceiling panel side) with the wind direction plates opened during operation.

During operation, the wind direction plates 33 rotate according to the operation status as illustrated in FIG. 5. Accordingly, the air blowoff openings 32 appear on the bottom surface of the decorative panel 3. Most of the air blown from the air blowoff openings 32 is guided along the surfaces of the straight-line portions 331 of the wind direction plates 33 and is blown from the four sides to the interior of the room at a predetermined blowoff angle.

Figure 6:
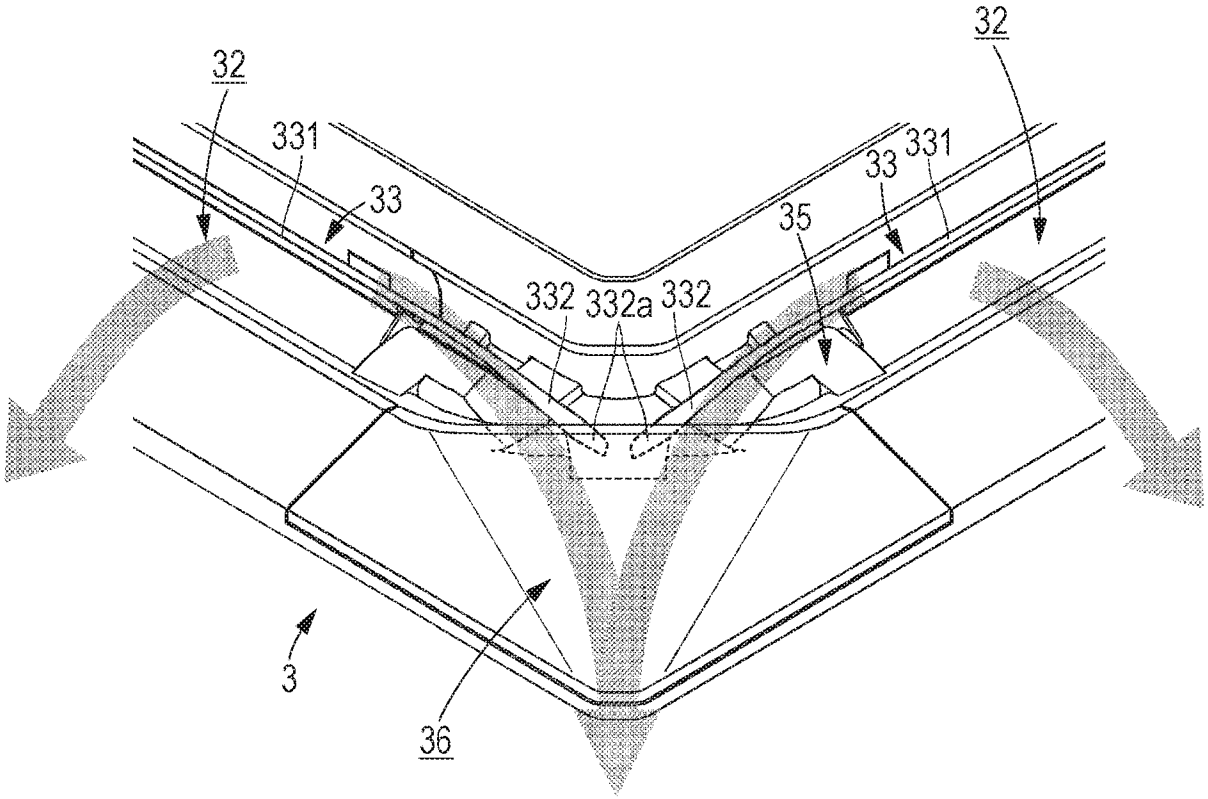
FIG. 6 is a perspective enlarged view of a corner portion illustrated in FIG. 5.

Part of the air blown from the both ends of the air blowoff openings 32 is guided to the tips 332*a* of the inclined portions 332 along the inner peripheral surfaces as illustrated in FIG. 6. Accordingly, the air is blown from the four corner portions 36 of the decorative panel 3 to the interior of the room.

In this manner, as illustrated in FIG. 5, the conditioned air is blown to all directions (total eight directions) including the four directions from the sides of the decorative panel 3 and the four directions from the four corner portions 36.

Figure 9:
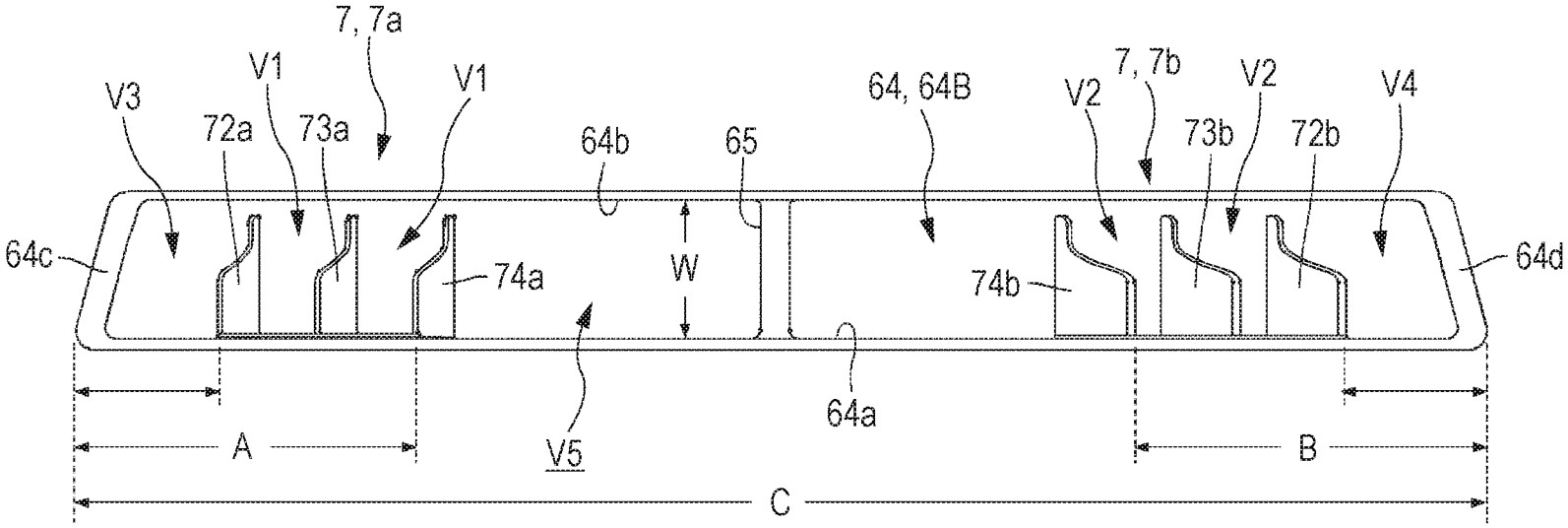
FIG. 9 is an enlarged front view of an air blowoff path seen from the bottom side (ceiling panel side)

In the embodiment, as illustrated in FIGS. 7 to 9, airflow guide vanes 7 are provided inside the air blowoff paths 64. The airflow guide vanes 7 blow off forcibly part of the air flowing through the air blowoff paths 64 (the conditioned air) toward the lateral sides of the air blowoff openings 32 (the incline portion 332 sides of the wind direction plates 33, that is, the short sides of the air blowoff openings 32). Accordingly, a larger volume of air is directed to the inclined portions 332 of the wind direction plates 33 to increase the volume of air blown from the corner portions 36. The airflow guide vanes 7 are made of a synthetic resin. The surfaces of the airflow guide vanes 7 are preferably subjected to a flocking process for prevention of dew condensation.

In the embodiment, the airflow guide vanes 7 include two kinds of airflow guide vanes: a first airflow guide vane 7*a* illustrated in FIGS. 12A to 12D and a second airflow guide vane 7*b* illustrated in FIGS. 13A to 13D. The first airflow guide vane 7*a* is disposed near the one short side wall 64*c* of the air blowoff path 64. The second airflow guide vane 7*b* is disposed near the other short side wall 64*d* of the air blowoff path 64. The first airflow guide vane 7*a* directs part of the blown airflow of the conditioned air toward the one short side of the air blowoff opening 32. The second airflow guide vane 7*b* directs part of the blown airflow of the conditioned air toward the other short side of the air blowoff opening 32.

Figure 12A:
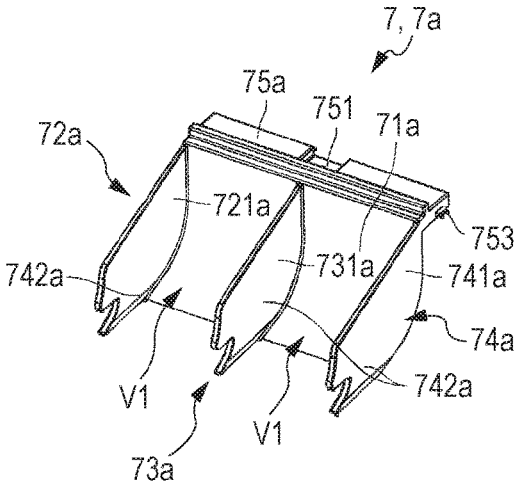
FIG. 12A is a perspective view of a first airflow guide vane seen from the front side.
Figure 12B:
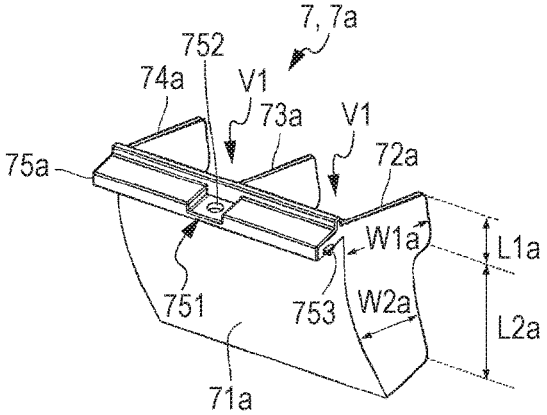
FIG. 12B is a perspective view of the first airflow guide vane seen from the rear side.
Figure 12C:
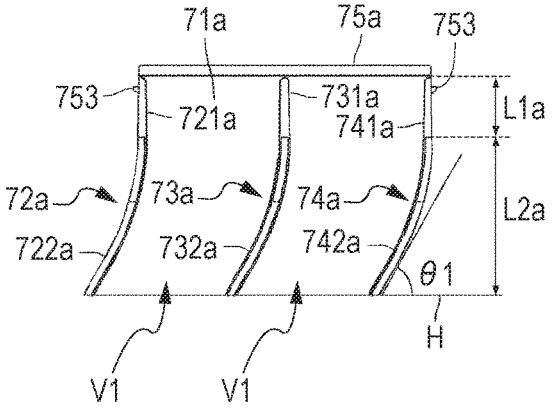
FIG. 12C is a front view of the first airflow guide vane.

For the convenience of description, the upstream side in FIG. 12C (FIG. 13C) (the inflow side of the air blowoff path 64) is designated as base end side, the lower end side in FIG. 12C (FIG. 13C) (the outflow side of the air blowoff path 64) is designated as leading end side, and the right-left direction in FIG. 12C (FIG. 13C) is designated as width direction. In addition, the direction of airflow is defined as a direction from top to bottom in FIG. 12C.

As illustrated in FIGS. 12A to 12D, the first airflow guide vanes 7*a* each include a base plate 71*a* and three guide fins 72*a*, 73*a*, and 74*a*. The base plate 71*a* is disposed in parallel to the long side wall 64*a* of the air blowoff path 64 on the casing main body 2 side. The guide fins 72*a*, 73*a*, and 74*a* are vertically erected from the surface of the base plate 71*a*. Specifically, the guide fins 72*a*, 73*a*, and 74*a* are vertically erected from the long side wall 64*a* toward the long side wall 64*b* of the air blowoff path 64. The guide fins 72*a*, 73*a*, and 74*a* are disposed in parallel to one another with a predetermined space therebetween.

The base plate 71*a* is a flat plate that has the back surface in abutment with the long side wall 64*a* of the air blowoff path 64 in parallel to the long side wall 64*a*. The both ends of the base plate 71*a* are formed in the width direction in an arc shape with a predetermined curvature suited to the shape of the first guide fin 72*a* and the third guide fin 74*a*.

The first guide fin 72*a* is vertically erected from one end (the left end in FIG. 12C) of the base plate 71*a* in the width direction. The second guide fin 73*a* is vertically erected from almost the center of the base plate 71*a* in the width direction. The third guide fin 74*a* is vertically erected from the other end (the right end in FIG. 12C) of the base plate 71*a* in the width direction. They are disposed in parallel to one another with a predetermined space therebetween.

A lock piece 75*a* is provided at the upper end of the base plate 71*a*. The lock piece 75*a* is a member to attach the first airflow guide vane 7*a* to the long side wall 64*a* of the air blowoff path 64. The lock piece 75*a* is used to fix the first airflow guide vane 7*a* to a screwing portion 66 of the air blowoff path 64. The lock piece 75*a* is a constant-width tongue piece. The lock piece 75*a* is erected at right angles with the base plate 71*a* from the upper end of the back surface of the base plate 71*a* (the upper end on the front side of the plane in FIG. 12B). The lock piece 75*a* extends up to the both ends of the base plate 71*a* in the width direction.

The lock piece 75*a* has a concave portion 751 lower by one step in the thickness direction in the center thereof. A screw hole 752 is formed in the concave portion 751. Lock claws 753 and 753 are provided on the both sides of the lock piece 75*a*. The lock claws 753 and 753 are locked in lock concaves 662 of the screwing portion 66 (see FIG. 14A).

Next, also referring to FIG. 12C, the first to third guide fins 72*a*, 73*a*, and 74*a* include base end portions 721*a*, 731*a*, and 741*a* and leading end portions 722*a*, 732*a*, and 742*a*, respectively. The base end portions 721*a*, 731*a*, and 741*a* are formed in a flat plate shape parallel to the direction of airflow. The leading end portions 722*a*, 732*a*, and 742*a* are inclined in an arc shape with a predetermined curvature toward the downstream side from the lower ends of the base end portions 721*a*, 731*a*, and 741*a*. That is, the respective leading end portions 722*a*, 732*a*, and 742*a* of the first to third guide fins 72*a*, 73*a*, and 74*a* have arc surfaces. In the embodiment, the arc surfaces have an inclination angle θ1 of 60° with respect to a virtual horizontal plane H and extend diagonally downward left. In this manner, the arc surfaces have an obtuse inclination angle with respect to the direction of airflow. In the embodiment, the virtual horizontal plane H is a plane orthogonal to the direction of airflow of the air blowoff path 64.

The first to third guide fins 72*a*, 73*a*, and 74*a* are disposed at equal intervals. An air guide path V1 is formed between the first guide fin 72*a* and the second guide fin 73*a*, and between the second guide fin 73*a* and the third guide fin 74*a*.

Figure 12D:
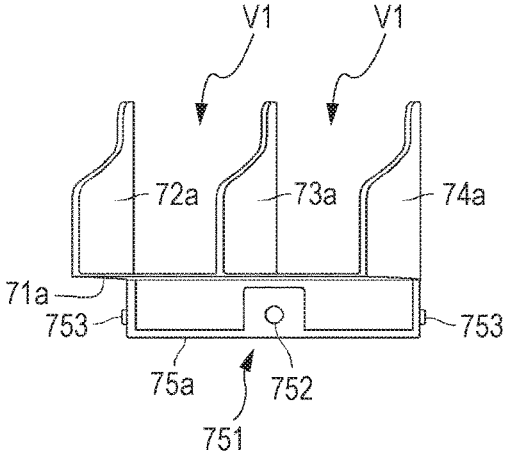
FIG. 12D is a bottom view of the first airflow guide vane.

The base end portions 721*a*, 731*a*, and 741*a* have a length L1*a* from the upper end of the base plate 71*a* (a longitudinal length in FIG. 12D). The base end portions 721*a*, 731*a*, and 741*a* have a width W1*a* almost equal to a width W of the air blowoff path 64 (see FIG. 9). The leading end portions 722*a*, 732*a*, and 742*a* have a length L2*a* from the lower ends of the base end portions 721*a*, 731*a*, and 741*a* to the tips of the leading end portions 722*a*, 732*a*, and 742*a*. The leading end portions 722*a*, 732*a*, and 742*a* have a width W2*a* gradually smaller with increasing proximity to the tips. In the embodiment, the length L1*a* of the base end portions 721*a*, 731*a*, and 741*a* is equivalent to ⅓ of a path length L from an inflow-side opening surface F1 to an outflow-side opening surface F2 of the air blowoff path 64 (see FIG. 10). The length L2*a* of the leading end portions 722*a*, 732*a*, and 742*a* is equivalent to ⅔ of the path length L.

According to this, a gap between the long side wall 64*a* and the long side wall 64*b* opposing to the long side wall 64*a* of the air blowoff path 64 is hardly formed at the positions corresponding to the base end portions 721*a*, 731*a*, and 741*a* with the length L1*a* of the first to third guide fins 72*a*, 73*a*, and 74*a*. The gap is gradually larger at the positions corresponding to the leading end portions 722*a*, 732*a*, and 742*a* with the length L2*a*. Therefore, the air guided to the air guide path V1 is first forcibly guided diagonally downward left along the side surfaces of the first to third guide fins 72*a*, 73*a*, and 74*a*. Since the gap is larger with increasing proximity to the outflow side, the air guided diagonally downward left is collected together with the surrounding air on the outflow side and is blown in the diagonal direction.

As illustrated in FIGS. 13A to 13D, the second airflow guide vane 7*b* is formed in almost the same manner as the first airflow guide vane 7*a* described above. The second airflow guide vane 7*b* includes a base plate 71*b* and three guide fins 72*b*, 73*b*, and 74*b*. The base plate 71*b* is disposed in parallel to the long side wall 64*a* of the air blowoff path 64 on the casing main body 2 side. The guide fins 72*b*, 73*b*, and 74*b* are vertically erected from the surface of the base plate 71*b*. Specifically, the guide fins 72*b*, 73*b*, and 74*b* are vertically erected from the long side wall 64*a* toward the long side wall 64*b* of the air blowoff path 64. The guide fins 72*b*, 73*b*, and 74*b* are disposed in parallel to one another with a predetermined space therebetween.

The base plate 71*b* is a flat plate that has the back surface in abutment with the long side wall 64*a* of the air blowoff path 64 in parallel to the long side wall 64*a*. The both ends of the base plate 71*b* are formed in the width direction in an arc shape with a predetermined curvature suited to the shape of the first guide fin 72*b* and the third guide fin 74*b*.

The first guide fin 72*b* is vertically erected from one end (the right end in FIG. 13C) of the base plate 71*b* in the width direction. The second guide fin 73*b* is vertically erected from almost the center of the base plate 71*b* in the width direction. The third guide fin 74*b* is vertically erected from the other end (the left end in FIG. 13C) of the base plate 71*b* in the width direction. They are disposed in parallel to one another with a predetermined space therebetween.

A lock piece 75*b* is provided at the upper end of the base plate 71*b*. The lock piece 75*b* is a member to attach the second airflow guide vane 7*b* to the long side wall 64*a* of the air blowoff path 64. The lock piece 75*b* is used to fix the second airflow guide vane 7*b* to the screwing portion 66 of the air blowoff path 64. The lock piece 75*b* is a constant-width tongue piece. The lock piece 75*b* is erected at right angles with the base plate 71*b* from the upper end of the back surface of the base plate 71*b* (the upper end on the front side of the plane in FIG. 13B). The lock piece 75*b* extends up to both ends of the base plate 71*b* in the width direction.

The lock piece 75*b* has a concave portion 751 lower by one step in the thickness direction in the center thereof. A screw hole 752 is formed in the concave portion 751. Lock claws 753 and 753 are provided on the both sides of the lock piece 75*b*. The lock claws 753 and 753 are locked in the lock concaves 662 of the screwing portion 66 (see FIG. 14A).

Figure 13A:
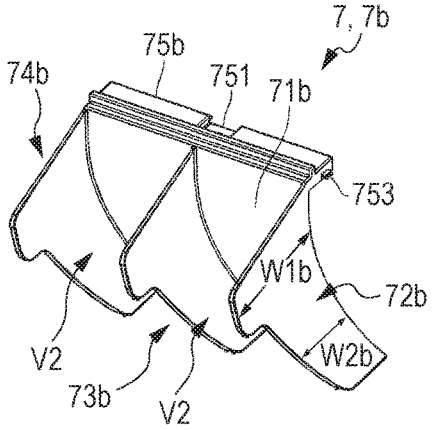
FIG. 13A is a perspective view of a second airflow guide vane seen from the front side.
Figure 13B:
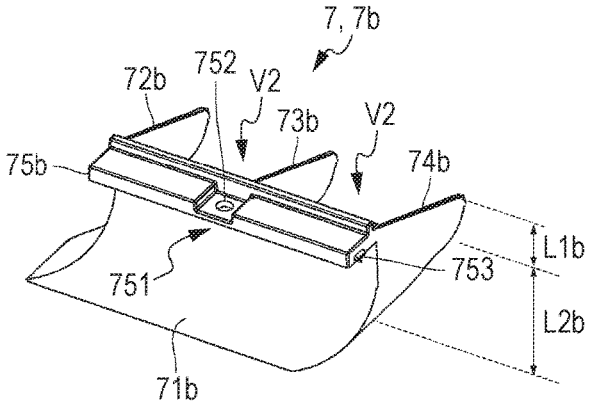
FIG. 13B is a perspective view of the second airflow guide vane seen from the rear side.
Figure 13C:
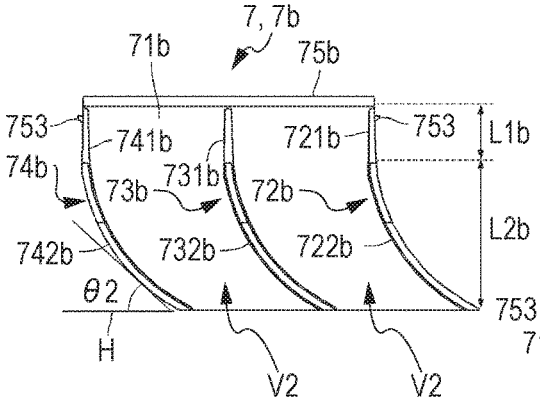
FIG. 13C is a front view of the second airflow guide vane.

Next, also referring to FIG. 13C, the first to third guide fins 72*b*, 73*b*, and 74*b* include base end portions 721*b*, 731*b*, and 741*b* and leading end portions 722*b*, 732*b*, and 742*b*, respectively. The base end portions 721*b*, 731*b*, and 741*b* are formed in a flat plate shape parallel to the direction of airflow. The leading end portions 722*b*, 732*b*, and 742*b* are inclined in an arc shape with a predetermined curvature toward the downstream side from the lower ends of the base end portions 721*b*, 731*b*, and 741*b*. That is, the respective leading end portions 722*b*, 732*b*, and 742*b* of the first to third guide fins 72*b*, 73*b*, and 74*b* have arc surfaces. In the embodiment, the arc surfaces have an inclination angle θ2 of 30° with respect to the virtual horizontal plane H and extend diagonally downward right. In this manner, the arc surfaces have an acute inclination angle with respect to the direction of airflow.

The first to third guide fins 72*b*, 73*b*, and 74*b* are disposed at equal intervals. An air guide path V2 is formed between the first guide fin 72*b* and the second guide fin 73*b*, and between the second guide fin 73*b* and the third guide fin 74*b*.

Figure 13D:
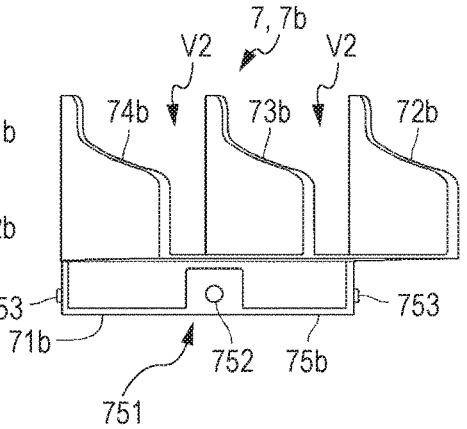
FIG. 13D is a bottom view of the second airflow guide vane.

The base end portions 721*b*, 731*b*, and 741*b* have a length L1*b* from the upper end of the base plate 71*b* (a longitudinal length in FIG. 13D). The base end portions 721*b*, 731*b*, and 741*b* have a width W1*b* almost equal to the width W of the air blowoff path 64 (see FIG. 9). The leading end portions 722*b*, 732*b*, and 742*b* have a length L2*b* from the lower ends of the base end portions 721*b*, 731*b*, and 741*b* to the tips of the leading end portions 722*b*, 732*b*, and 742*b*. The leading end portions 722*b*, 732*b*, and 742*b* have a width W2*b* gradually smaller with increasing proximity to the tips. In the embodiment, the length L1*b* of the base end portions 721*b*, 731*b*, and 741*b* is equivalent to ⅓ of the path length L from the inflow-side opening surface F1 to the outflow-side opening surface F2 of the air blowoff path 64 (see FIG. 10). The length L2*b* of the leading end portions 722*b*, 732*b*, and 742*b* is equivalent to ⅔ of the path length L.

According to this, a gap between the long side wall 64*a* and the long side wall 64*b* opposing to the long side wall 64*a* of the air blowoff path 64 is hardly formed at the positions corresponding to the base end portions 721*b*, 731*b*, and 741*b* with the length L1*b* of the first to third guide fins 72*b*, 73*b*, and 74*b*. The gap is gradually larger at the positions corresponding to the leading end portions 722*b*, 732*b*, and 742*b* with the length L2*b*. Therefore, the air guided to the air guide path V2 is first forcibly guided diagonally downward right along the side surfaces of the first to third guide fins 72*b*, 73*b*, and 74*b*. Since the gap is larger with increasing proximity to the outflow side, the air guided diagonally downward right is collected together with the surrounding air on the outflow side and is blown in the diagonal direction.

In this manner, in the embodiment, the direction of inclination of the first to third guide fins 72*a*, 73*a*, and 74*a* of the first airflow guide vane 7*a* and the direction of inclination of the first to third guide fins 72*b*, 73*b*, and 74*b* of the second airflow guide vane 7*b* are separated from each other. In addition, the inclination angle θ1 of the first to third guide fins 72*a*, 73*a*, and 74*a* with respect to the virtual horizontal plane H and the inclination angle θ2 of the first to third guide fins 72*b*, 73*b*, and 74*b* with respect to the virtual horizontal plane H are in the relationship θ1>θ2.

In the embodiment, the airflow guide vanes 7 (7*a* and 7*b*) are provided with the three guide fins 72*a*, 73*a*, and 74*a* (72*b*, 73*b*, and 74*b*). The number of the guide fins provided on the airflow guide vanes 7 (7*a* and 7*b*) is preferably at least three or more, more preferably three or four. That is, when the number of the guide fins is two, it is hard to obtain the effect of bending the airflow.

Figure 10:
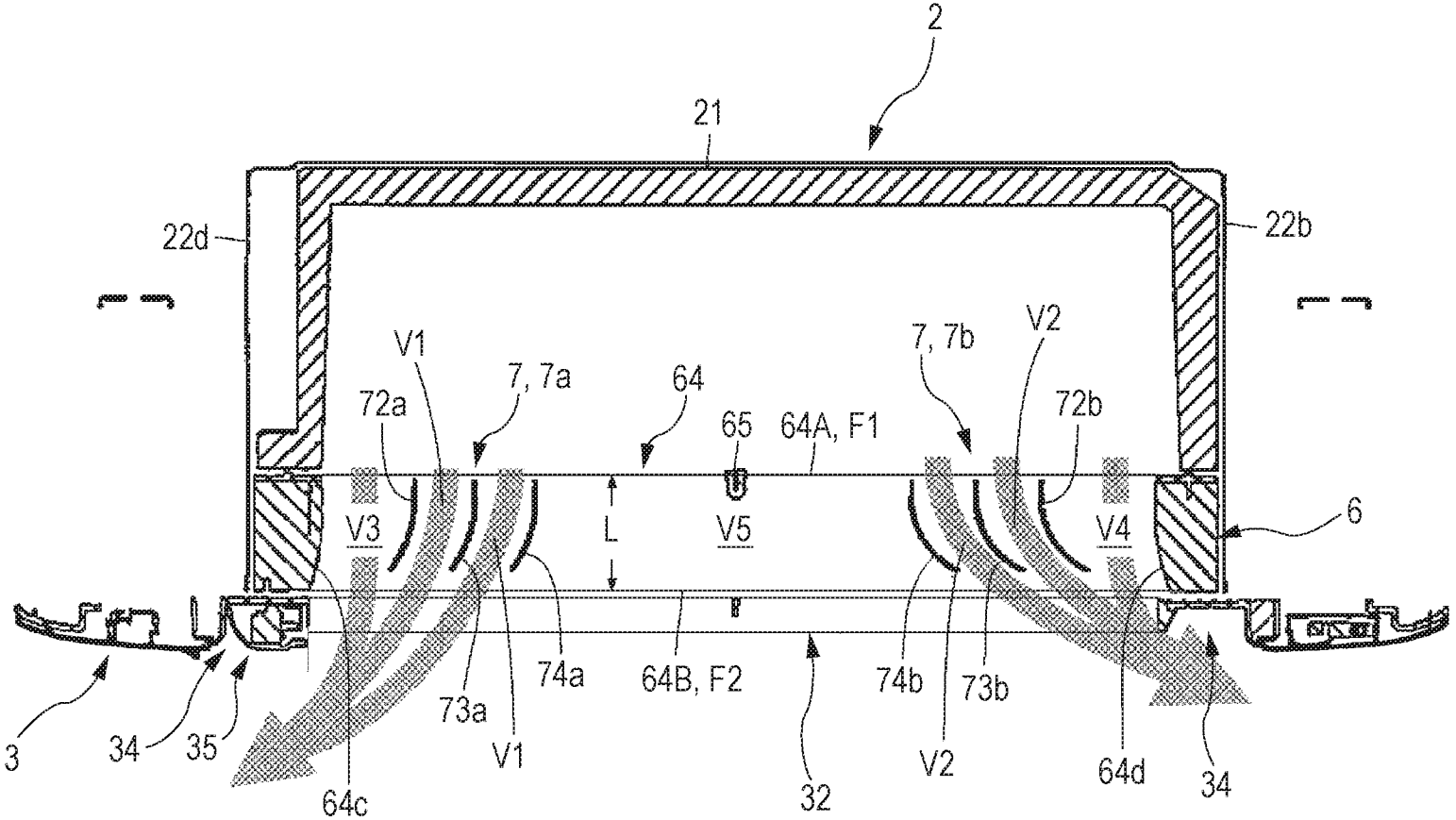
FIG. 10 is a cross-section view of FIG. 8 taken along line A-A.

Referring to FIG. 10, the airflow guide vanes 7 (7*a* and 7*b*) are provided such that the tips (the lower ends in FIG. 10) of the leading end portions 722*a*, 732*a*, and 742*a* (722*b*, 732*b*, and 742*b*) of the guide fins 72*a*, 73*a*, and 74*a* (72*b*, 73*b*, and 74*b*) are positioned more inside than the opening surface F2 of the outflow-side opening portion 64B of the air blowoff path 64. According to this, by disposing the lower ends of the guide fins 72*a*, 73*a*, and 74*a* (72*b*, 73*b*, and 74*b*) more inside than the opening surface F2 of the air blowoff path 64, the outer appearance does not become deteriorated and the guide fins are less likely to protrude from the outflow-side opening portion 64B of the bottom surface B, thereby allowing easy packaging.

As described above with reference to FIGS. 8 and 9, in the embodiment, the two kinds of airflow guide vanes 7*a* and 7*b* different in inclination angle are included in the air blowoff paths 64. Of these guide vanes, the first airflow guide vane 7*a* is disposed with a predetermined space from the one short side wall 64*c*. An air guide path V3 is formed between the short side wall 64*c* and the first guide fin 72*a*.

The other second airflow guide vane 7*b* is disposed with a predetermined space from the other short side wall 64*d*. An air guide path V4 is formed between the short side wall 64*d* and the first guide fin 72*b*. A central air guide path V5 for blowing the air to the air blowoff opening 32 is formed between the first airflow guide vane 7*a* and the second airflow guide vane 7*b*.

According to this, as illustrated in FIG. 10, the air guided to the first airflow guide vane 7*a* passes through the air guide path V1, and is forcibly bent leftward and blown diagonally downward left. At that time, the air having passed through the air guide path V1 is mixed with the airflow having come downward along the air guide path V3 positioned on the left side, and is blown from the air blowoff opening 32 toward the wind guide path 34 on the left side.

The stepping motor 35 is disposed on the left side of the air blowoff opening 32 of the decorative panel 3 (the short side wall 64*c* side) to cover almost the entire wind guide path 34. The first airflow guide vane 7*a* includes the obtuse-angled guide fins 72*a* to 74*a* to blow high-flow velocity wind while avoiding the stepping motor 35. By blowing the high-flow velocity wind toward the wind direction plate 33, the air is sent into a narrow space between the wind direction plates 33 and the stepping motor 35, and then is sent to the corner portion 36. In addition, the air is blown toward the short side wall 64*c* of the air blowoff path 64 while avoiding the stepping motor 35. Accordingly, it is also possible to suppress the generation of dew condensation caused by applying the cool air to the stepping motor 35 during cooling operation.

Meanwhile, the air guided to the second airflow guide vane 7*b* passes through the air guide path V2, and is forcibly bend rightward and is blown diagonally downward right. At that time, the air having passed through the air guide path V2 is mixed with the airflow having come downward through the air guide path V4 on the right side, and is blown from the air blowoff opening 32 to the right side.

Accordingly, by passing the air through the acute-angled guide fins 72*b* to 74*b* of the second airflow guide vane 7*b*, it is possible to ensure reliably the volume of air flowing toward the wind guide path 34, although the flow velocity of the air becomes slightly lower. Accordingly, it is possible to achieve stable blowing of the air from the corner portion 36.

Specifically, as illustrated in FIG. 5, the ends of the four air blowoff paths 64 surrounding the four sides of the virtual square Q are opposed to each other at the corner portions 36. At the corner portions 36, the obtuse-angled airflow from the first airflow guide vane 7*a* of one of the adjacent air blowoff paths 64 and the acute-angled airflow from the second airflow guide vane 7*b* of the other of the adjacent air blowoff paths 64 merge with each other and are blown from the wind guide path 34 at the corner portion 36 to the interior of the room. That is, the airflow guide vanes 7*a* and 7*b* allow part of the blown airflow of the conditioned air to be blown toward the wind guide paths 34 from the adjacent air blowoff paths 64.

A more preferred mode of disposition of the airflow guide vanes 7*a* and 7*b* will be described below. As illustrated in FIG. 9, the distance from the one short side wall 64*c* to the outmost guide fin (the third guide fin 74*a*) of the first airflow guide vane 7*a* is designated as A. The distance from the other short side wall 64*d* to the outmost guide fin (the third guide fin 74*b*) of the second airflow guide vane 7*b* is designated as B. The length of the long side wall 64*a* of the air blowoff path 64 is designated as C. In this case, the first airflow guide vane 7*a* and the second airflow guide vane 7*b* are positioned to satisfy the relationship $(A+B)/C<0.5$.

Specifically, when $(A+B)/C>0.5$, the length of the central air guide path V5 formed between the first airflow guide vane 7*a* and the second airflow guide vane 7*b* becomes ½ or shorter relative to the opening length C of the air blowoff path 64. Accordingly, the velocity of the air flowing in the central air guide path V5 becomes lower to make it difficult to achieve efficient blowing to all directions.

Figure 11:
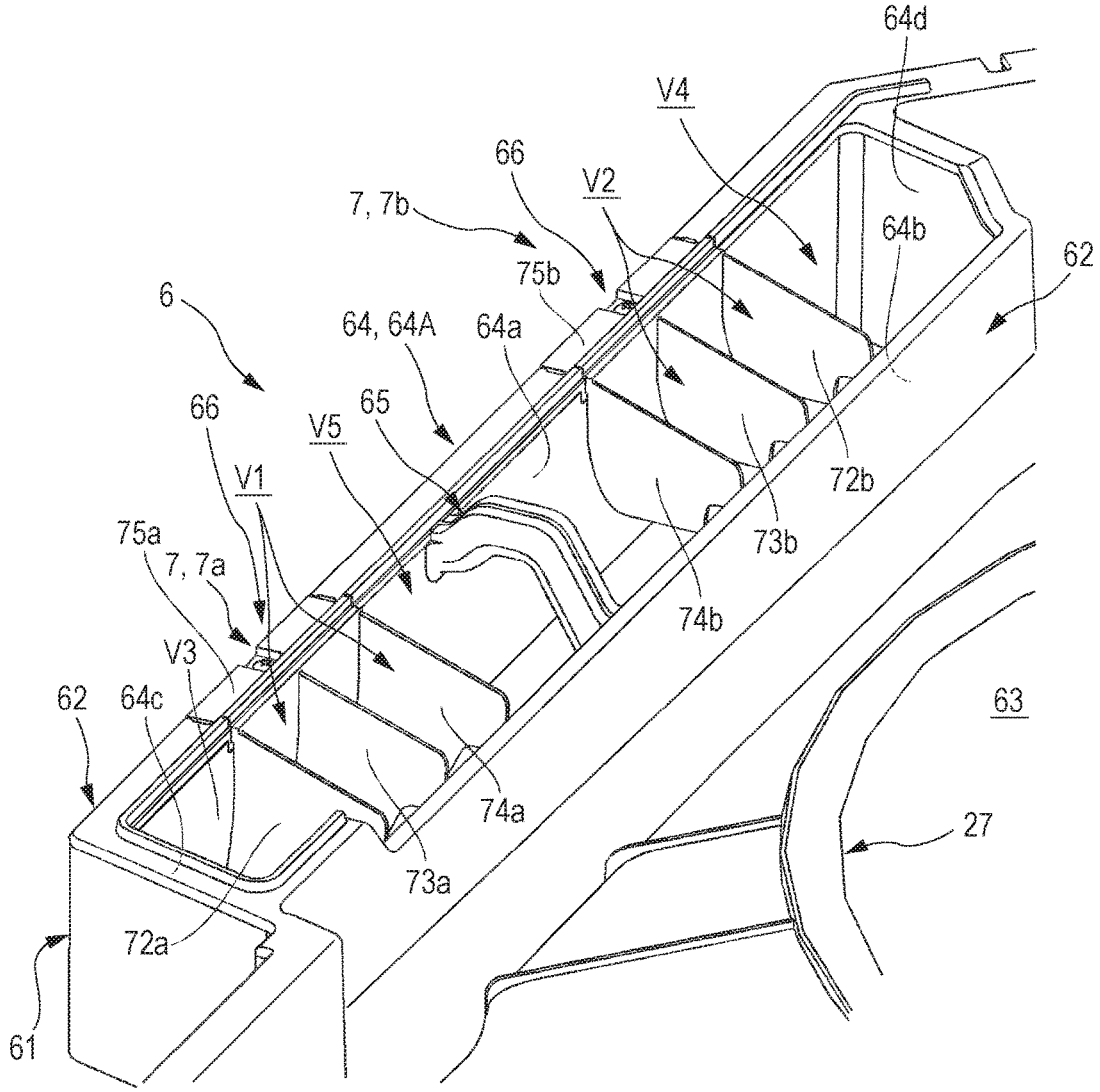
FIG. 11 is a perspective enlarged view of an inflow-side opening portion and its neighborhood of the air blowoff path in a drain pan.

As illustrated in FIG. 11, the airflow guide vanes 7*a* and 7*b* are screwed to the edge of the inflow-side opening portion 64A of the air blowoff path 64. The screwing portions 66 for screwing the airflow guide vanes 7 are provided on the drain sheet 62 of the inflow-side opening portion 64A of the air blowoff path 64 (the upper surface side in FIG. 6).

Figure 14A:
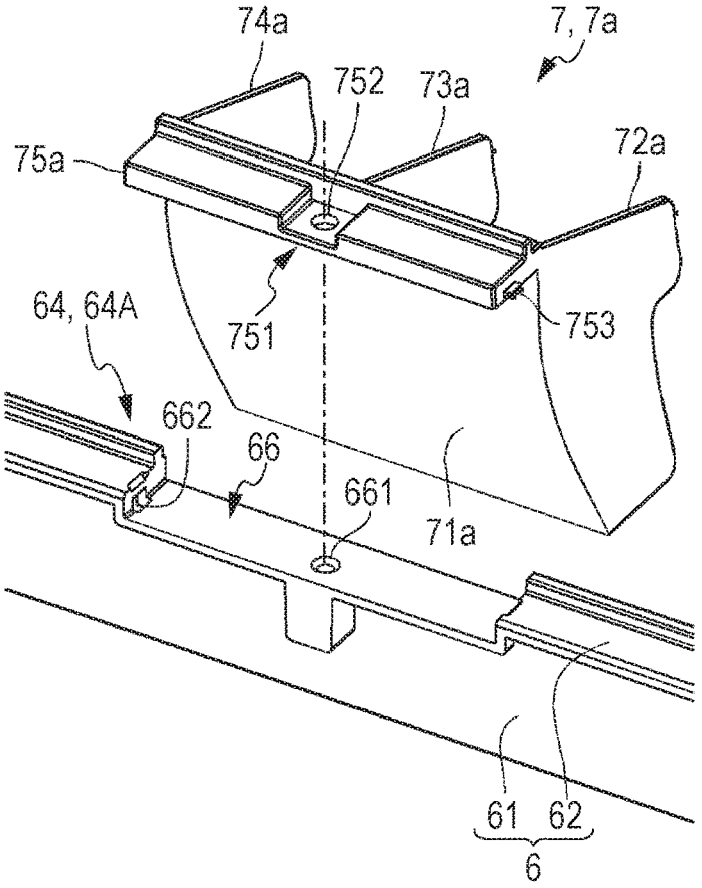
FIG. 14A is a perspective view for describing a method for attaching the airflow guide vane to the air blowoff path.

As illustrated in FIG. 14A, the screwing portions 66 are concave portions formed of the material for the drain sheet 62 and recessed by one step in the thickness direction. The screwing portions 66 are provided at two places with a predetermined space therebetween at the inflow-side opening portion 64A of the long side wall 64*a* of the air blowoff path 64.

The screwing portions 66 are concave portions of the same shape and each have a screw hole 661 in the center. The corners of the screwing portion 66 between the bottom wall and the side walls have lock concaves 662 and 662. The lock claws 753 and 753 provided on the airflow guide vanes 7 are locked in the lock concaves 662 and 662.

In the embodiment, even the airflow guide vanes 7*a* and 7*b* are attached, the air blowoff paths 64 maintain sufficient mechanical strength and thus the screwing portions 66 are formed at part of the resin drain sheet 62. In particular, the circumferential portion of the screw holes 661 protrudes in a columnar shape toward the drain pan main body 61.

Figure 14B:
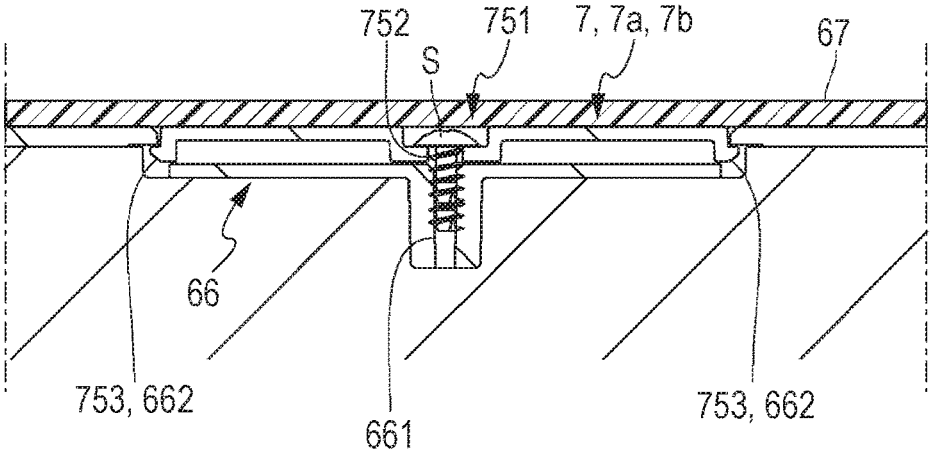
FIG. 14B is a partial cross-section view for the same.

Next, referring to FIG. 14B, an example of a method for attaching the airflow guide vanes 7 to the air blowoff path 64 will be described. Since the airflow guide vanes 7 (7*a* and 7*b*) are attached by the same method, only the procedure for attaching the first airflow guide vane 7*a* will be explained below.

First, while the one lock claw 753 of the lock piece 75*a* is locked in the one lock concave 662, the other lock claw 753 is pushed into the other lock concave 662. Accordingly, the lock piece 75*a* is tentatively retained in the lock concave 662.

Next, a screw S is inserted into the screw hole 752 in the lock piece 75*a* of the first airflow guide vane 7*a*. The lock piece 75*a* is screwed to the screwing portion 66 via the screw hole 752 and the screw hole 661. Accordingly, the upper end surface of the first airflow guide vane 7*a* becomes flush with the upper end surface of the drain pan 6. A seal material 67 is attached to the upper end surfaces to integrate the first airflow guide vane 7*a* with the air blowoff path 64. Since the upper end surface of the first airflow guide vane 7*a* is flush with the upper end surface of the drain pan 6, the seal material 67 is easy to attach to the upper end surfaces. As a result, the adhesiveness of the seal material 67 is enhanced.

In the embodiment, to suppress reduction in the volume of airflow into the air blowoff path 64, a support column 65 for enhancing the mechanical strength of the air blowoff path 64 is provided at the inflow-side opening portion 64A of the air blowoff path 64 (the upper surface side in FIG. 11) as illustrated in FIG. 11.

The support column 65 extends over almost the middles of the long side walls 64*a* and 64*b* opposed to each other. At least part of the support column 65 protrudes more upward than the inflow-side opening surface F1 of the air blowoff path 64. The thus configured support column 65 enhances the mechanical strength of the air blowoff path 64 and is less prone to interfere with the flow of the air in the air blowoff path 64. Accordingly, it is possible to suppress reduction in the volume of air blown from the air blowoff opening 32.

In the embodiment, of the airflow guide vanes 7, the first airflow guide vane 7*a* is disposed on the one short side wall 64*c* side, and the second airflow guide vane 7*b* is disposed on the other short side wall 64*d* side. Accordingly, the airflows are collected from the two directions at the corner portions 36 where the ends of the air blowoff openings 32 are adjacent to each other. Alternatively, of the airflow guide vanes 7, at least either the first airflow guide vane 7*a* or the second airflow guide vane 7*b* may be provided. For example, of the airflow guide vanes 7, the first airflow guide vane 7*a* may not be provided but the second airflow guide vane 7*b* may be provided. According to this, it is possible to send wind to the corner portions 36 by the second airflow guide vanes 7*b* capable of sending the air directly to the wind guide paths 34. It is also possible to obtain a sufficient volume of air blown from the corner portions 36.

As described above, according to the embodiment of the present disclosure, the airflow guide vanes are disposed in the cuboidal air blowoff path. In addition, part of the air flowing in the air blowoff path is forcibly blown by the airflow guide vanes toward the short side of the air blowoff opening. This allows air blowing to all directions without using a complicated structure.

Further, according to the embodiment of the present disclosure, the length of the central air guide path formed between the first airflow guide vane and the second airflow guide vane becomes ½ or more of the length C of the long side wall of the air blowoff path. Accordingly, the wind velocity of the air flowing in the central air guide path is less prone to decline. This allows even and efficient air blowing to all directions.

In the embodiment, the airflow guide vanes 7 (7*a* and 7*b*) are provided such that the tips (lower ends) of the leading end portions 722*a*, 732*a*, and 742*a* (722*b*, 732*b*, and 742*b*) of the guide fins 72*a*, 73*a*, and 74*a* (72*b*, 73*b*, and 74*b*) are positioned more inside the air blowoff path 64 than the opening surface F2 of the outflow-side opening portion 64B of the air blowoff path 64. Instead of this, the airflow guide vanes 7 (7*a* and 7*b*) may be provided such that the tips (lower ends) of the leading end portions 722*a*, 732*a*, and 742*a* (722*b*, 732*b*, and 742*b*) of the guide fins 72*a*, 73*a*, and 74*a* (72*b*, 73*b*, and 74*b*) are positioned to be flush with the opening surface F2 of the outflow-side opening portion 64B of the air blowoff path 64.

The expressions used herein for indicating shapes or states such as "cuboidal," "vertical," "parallel," "right angle," "same," "orthogonal," "center," "all directions," and "horizontal" refer to not only strict shapes or states but also approximate shapes or states different from the strict shapes and states without deviating from the influences and effects of the strict shapes or states.

The foregoing detailed description has been presented for the purposes of illustration and description. Many modifications and variations are possible in light of the above teaching. It is not intended to be exhaustive or to limit the subject matter described herein to the precise form disclosed. Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims appended hereto.

What is claimed is:

1. A ceiling-embedded air conditioner comprising:

a casing main body embedded in a ceiling;

a decorative panel mounted on a bottom surface of the casing main body;

a turbo fan disposed in the casing main body;

a heat exchanger disposed in the casing main body to surround an outer periphery of the turbo fan;

a drain pan that is disposed in the casing main body along a bottom side of the heat exchanger;

an air suction path that is disposed within the casing main body and upstream of the heat exchanger, wherein the heat exchanger is positioned in the drain pan and the air suction path reaches the turbo fan;

four air blowoff paths for conditioned air having passed through the heat exchanger, the four air blowoff paths being provided at four sides surrounding the air suction path wherein the four sides are parallel to four sides of the casing main body;

an air suction opening that is provided in the decorative panel and communicates with the air suction path; and four air blowoff openings that are provided in the decorative panel, wherein each air blowoff opening communicates with one of the air blowoff paths, wind guide paths that are concave grooves are provided at four corners of the decorative panel, each wind guide path being arranged between two of the air blowoff openings adjacent to each other for guiding air from the two air blowoff openings to one of the four corners of the decorative panel, wind direction plates being provided in each of the air blowoff openings to cover each of the air blowoff openings and the wind guide paths adjacent thereto, wherein each of the air blowoff paths is formed in a cuboidal shape having a pair of second side walls disposed with a predetermined space therebetween in parallel to two sides of the four sides surrounding the air suction path and a pair of first side walls connecting ends of the second side walls wherein the first side walls are shorter than the second side walls, and airflow guide vanes are provided in each of the air blowoff paths to direct part of blown airflow of the conditioned air toward respective wind guide paths at first sides of each of the air blowoff openings in order to blow the conditioned air from the four corners.

2. The ceiling-embedded air conditioner according to claim 1, wherein the airflow guide vanes include:

a first airflow guide vane that directs part of the blown airflow of the conditioned air toward a first one of the first sides of a respective one of the air blowoff openings; and a second airflow guide vane that directs part of the blown airflow of the conditioned air toward a second one of the first sides of the respective one of the air blowoff openings.

3. The ceiling-embedded air conditioner according to claim 1, wherein the airflow guide vanes include:

a base plate disposed along the second side walls; and a plurality of guide fins that is vertically erected from the base plate in parallel to one another with a predetermined space therebetween, and the guide fins have upstream-side base end portions along the blown airflow and downstream-side leading end portions inclined in an arc shape in the direction of the airflow with a predetermined curvature, the upstream-side base end portions being formed as a flat plate parallel to the direction of airflow.

4. The ceiling-embedded air conditioner according to claim 3, wherein a width of the upstream-side base end portions of the guide fins is equal to a width between the second side walls and a width of the downstream-side leading end portions of the guide fins is gradually smaller with increasing proximity to a plurality of tips.

5. The ceiling-embedded air conditioner according to claim 3, wherein the upstream-side base end portions formed as a flat plate parallel to the airflow has a length of ⅓ of a path length of a respective one of the air blowoff paths, and the downstream-side leading end portions formed in an arc shape in the direction of the airflow has a length of ⅔ of the path length of the respective one of the air blowoff paths.

6. The ceiling-embedded air conditioner according to claim 3, further comprising a lock piece that is provided at an upper end of the base plate and attaches the airflow guide vane to a first side wall of the pair of second side walls of a respective one of the air blowoff paths.

7. The ceiling-embedded air conditioner according to claim 2, further comprising:

a stepping motor that is provided adjacent a first side wall of the pair of first side walls of a respective one of the air blowoff paths and rotates the wind direction plate, wherein the first airflow guide vane arranged on a side of the first side wall of the respective one of the air blowoff paths provided with the stepping motor, and the second airflow guide vane is arranged on a side of a second side wall of the pair of first side walls of the respective one of the air blowoff paths.

8. The ceiling-embedded air conditioner according to claim 7, wherein a direction of inclination of guide fins of the first airflow guide vane and a direction of inclination of the guide fins of the second airflow guide vane are different from each other, and an inclination angle $\theta 1$ of guide fins of the first airflow guide vane with respect to a horizontal plane and an inclination angle $\theta 2$ of guide fins of the second airflow guide vane with respect to the virtual horizontal plane are in a relationship $\theta 1 > \theta 2$.

9. The ceiling-embedded air conditioner according to claim 2, wherein the first airflow guide vane is arranged in a respective one of the air blowoff paths on a side of a first side wall of the pair of first side walls, the second airflow guide vane is arranged in the respective one of the air blowoff paths on a side of a second side wall of the pair of first side walls, the first and second airflow guide vanes include a base plate disposed along a first side wall of the pair of second side walls and a plurality of guide fins that is vertically erected from the base plate in parallel to one another with a predetermined space therebetween, and when a distance from the first side wall of the pair of first side walls to an outermost guide fin, as the outermost guide fin is most distant from the first side wall of the pair of first side walls out of the guide fins in the first airflow guide vane, is designated as A, a distance from the second side wall of the pair of first side walls to an outmost guide fin, as the outmost guide fin is most distant from the second side wall of the pair of first side walls out of the guide fins in the second airflow guide vane, is designated as B, and a length of the first side wall of the pair of second side walls of the respective one of the air blowoff paths is designated as C, the first and second airflow guide vanes are positioned to satisfy the relationship $(A+B)/C<0.5$.

10. The ceiling-embedded air conditioner according to claim 9, wherein the first and second airflow guide vanes are provided such that lower end portions of the guide fins are positioned to be flush with an opening surface of an outflow-side opening portion of the respective one of the air blowoff paths or are positioned more inside the respective one of the air blowoff paths than the opening surface.

11. The ceiling-embedded air conditioner according to claim 1, wherein each of the wind direction plates includes an inclined portion at two longitudinal ends thereof for guiding the air from a respective one of the air blowoff openings to a respective one of the four corners.

* * * * *